US005577484A

United States Patent [19]

Izutani et al.

[11] Patent Number: 5,577,484

[45] Date of Patent: Nov. 26, 1996

[54] METHOD AND APPARATUS FOR DETECTING TROUBLE IN EXHAUST-GAS RECIRCULATION SYSTEM

[75] Inventors: Takahide Izutani; Hidemi Onaka, both of Susono, Japan

[73] Assignee: Toyota Jidosha Kabushiki Kaisha, Aichi, Japan

[21] Appl. No.: 538,322

[22] Filed: Oct. 3, 1995

[30] Foreign Application Priority Data

Nov. 1, 1994 [JP] Japan ..... 6-268914

[51] Int. Cl.[6] ..... F02M 25/07

[52] U.S. Cl. ..... 123/571; 73/117.3

[58] Field of Search ..... 123/568, 571, 123/676; 73/117.3, 118.1, 118.2; 364/431.06

[56] References Cited

U.S. PATENT DOCUMENTS

| | | | |
|---|---|---|---|
| 4,390,001 | 6/1983 | Fujimoto | 123/571 |
| 4,428,355 | 1/1984 | Yokooku | 123/571 |
| 4,723,528 | 2/1988 | Tamura | 123/571 |
| 5,190,017 | 3/1993 | Cullen et al. | 123/571 |
| 5,341,300 | 8/1994 | Fujimoto | 123/571 |
| 5,368,005 | 11/1994 | Kako | 123/571 |
| 5,508,926 | 4/1996 | Wade | 123/571 |

FOREIGN PATENT DOCUMENTS

| | | |
|---|---|---|
| 57-41454 | 3/1982 | Japan . |
| 60-256546 | 12/1985 | Japan . |
| 63-75345 | 4/1988 | Japan . |

*Primary Examiner*—Willis R. Wolfe
*Attorney, Agent, or Firm*—Kenyon & Kenyon

[57] ABSTRACT

In the EGR system having an EGR control valve in an EGR passage, an orifice is provided on the exhaust side of the EGR control valve to define a negative pressure chamber between the EGR control valve and the orifice, and the pressure in the negative pressure chamber can be detected by a pressure-detector. When the operation state of the internal combustion engine is in a first operation zone wherein the amount of EGR is larger than a predetermined value, it is determined that clogging has occurred in the intake side EGR passage if the pressure value detected by the pressure-detector is smaller than a preset negative pressure value; while, it is determined that clogging has occurred in the exhaust side EGR passage if the pressure value detected by the pressure-detector is larger than the predetermined negative pressure value. An ON/OFF type pressure switch may be used as the pressure-detection means 17. As a result, it is possible to accurately detect the clogging position in the EGR passage without an increase in cost.

8 Claims, 14 Drawing Sheets

METHOD AND APPARATUS FOR DETECTING TROUBLE IN EXHAUST-GAS RECIRCULATION SYSTEM

BACKGROUND OF THE INVENTION

1. Field of the Invention

The present invention relates to a method and an apparatus for detecting trouble in an exhaust-gas recirculation (hereinafter referred to as "EGR") system of an internal combustion engine, particularly to a method and an apparatus capable of detecting trouble in an EGR control valve and the clogging of a passage in the EGR system as well as discriminating whether the clogging occurs upstream or downstream of the EGR control valve.

2. Description of the Related Art

To reduce an amount of $No_x$ in an exhaust gas, an EGR system, as is well known, wherein the exhaust gas flowing through an exhaust passage is recirculated to an intake passage of an internal combustion engine via an EGR passage is used. In the EGR system of such a type, an EGR control valve is usually provided in the EGR passage. The amount of EGR gas to be supplied to the intake passage of the internal combustion engine is controlled by the opening degree of the EGR control valve. However, the recirculation of exhaust gas may be continuously interrupted if the EGR control valve is broken or the EGR passage clogs. If such an inconvenience is left as it is, a large amount of $NO_x$ is continuously discharged because no EGR is conducted. In addition, the reduction of the amount of recirculating exhaust gas or the interruption of EGR due to the trouble of the EGR system is seldom found by the driver.

To solve such a problem, apparatuses, for diagnosing the trouble of EGR system, have been proposed wherein the opening degree of EGR control valve is controlled by the magnitude of a negative pressure introduced into a diaphragm chamber in the EGR control valve partitioned by a diaphragm. For example, Japanese Unexamined Patent Publication (Kokai) No. 63-75345 discloses an apparatus for diagnosing the trouble of EGR system of a diaphragm type comprising a pressure detection means provided upstream of EGR control valve and means for detecting the supply of negative pressure to the EGR control valve. According to the trouble detection apparatus disclosed in the above Patent Publication, "trouble" is determined if no flow of exhaust gas is detected by the pressure detection means when a negative pressure is supplied to the EGR control valve. Contrarily, "trouble" is also determined if the flow of exhaust gas is detected when no negative pressure is supplied to the EGR control valve.

According to this apparatus, however, although trouble in the EGR system can be diagnosed, it is impossible to determine whether the trouble is caused by the malfunction of the EGR control valve or by clogging of the EGR passage. Also, when the EGR passage is clogged, it is impossible to determine whether the clogging has occurred upstream or downstream of the EGR control valve. Accordingly, there is a problem in the above-mentioned trouble detection apparatus in that a long time is required identify the trouble in the EGR system, which results in a time-consuming repair operation.

SUMMARY OF THE INVENTION

An object of the present invention is to provide a trouble diagnosing apparatus for an exhaust-gas recirculation system comprising an EGR control valve in an EGR passage, which is capable of not only detecting the malfunction of the EGR control valve in the EGR system but also determining whether the clogging of the EGR passage occurs upstream or downstream of the EGR control valve when the EGR control valve is in a normal state.

To achieve the above object, the trouble diagnosing apparatus for an exhaust-gas recirculation system according to the present invention is a trouble diagnosing apparatus for an exhaust-gas recirculation system comprising an EGR control valve provided in an EGR passage communicating an exhaust passage with an intake passage of an internal combustion engine, for controlling a flow rate of recirculating exhaust gas, characterized in that the apparatus further comprises an orifice provided in the EGR passage, pressure detection means for detecting a pressure in the EGR passage between the orifice and the EGR control valve, operation state detection means for detecting an operation state of the internal combustion engine, operation zone determination means for determining whether the operation state of the internal combustion engine is in a first zone wherein an amount of EGR is larger than a predetermined value or in a second zone wherein an amount of EGR is smaller than the predetermined value, value-opening detection means for detecting an open sate of the EGR control valve, and trouble determination means for determining whether or not the clogging occurs in the EGR passage and whether the clogging occurs upstream or downstream of the EGR control valve, based on the operation zone and the pressure value detected by the pressure detection means when the EGR control valve is in the open state.

In this regard, a pressure switch; which is capable of changing its ON/OFF states when the negative pressure exceeds a predetermined value can be used as the pressure detection means. In this case, if the pressure switch does not reverse in the first operation zone of the engine wherein the negative pressure exceeds the predetermined value when the EGR control valve is normal and in the open state, it can be determined that the clogging occurs downstream of the EGR control valve, while if the pressure switch reverses in the second operation zone of the engine wherein the negative pressure is lower than the predetermined value when the EGR control valve is normal and in the open state, it can be determined that the clogging occurs upstream of the EGR control valve.

According to the trouble diagnosing apparatus for an exhaust-gas recirculation system according to the present invention, an orifice is provided, in addition to the EGR control valve for controlling a flow rate of recirculating exhaust gas, in the EGR passage communicating the exhaust passage to the intake passage of the internal combustion engine, and pressure detection means is provided for detecting a pressure in the EGR passage between the orifice and the EGR control valve. When the operation state of the internal combustion engine is in the first operation zone wherein an amount of EGR is larger than the predetermined value, the negative pressure increases in the EGR passage between the orifice and the EGR control valve in the normal state. Accordingly, if the negative pressure falls, it can be determined that the clogging occurs downstream of the EGR control valve. On the other hand, when the operation state is in the second operation zone wherein an amount of EGR is smaller than the predetermined value, the negative pressure is maintained at the smaller value in the EGR passage between the orifice and the EGR control valve in the normal state. Accordingly, if the negative pressure increases, it can be determined that the clogging occurs upstream of the EGR control valve.

DESCRIPTION OF THE PREFERRED EMBODIMENTS

Figure 1:
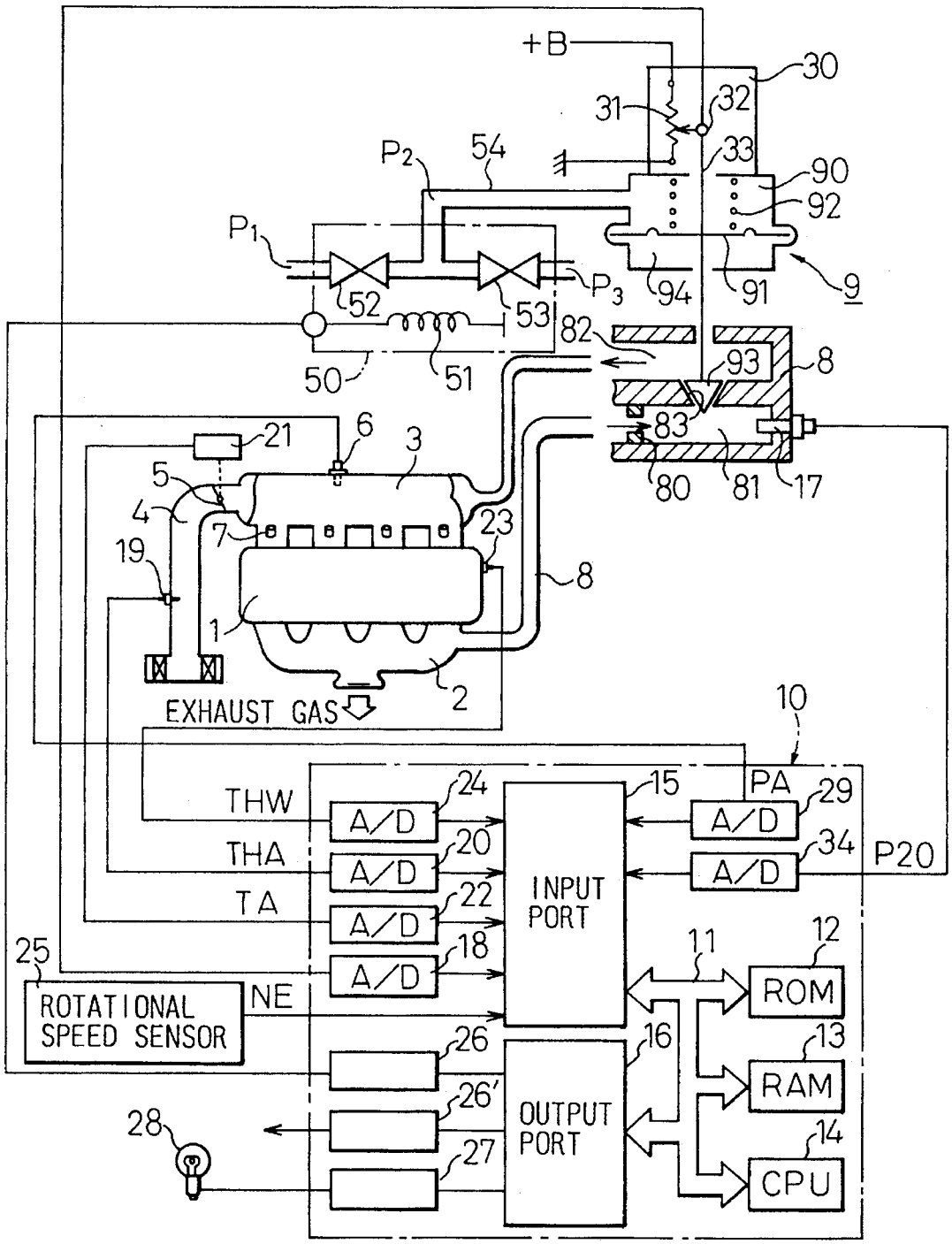
FIG. 1 illustrates a whole structure of one embodiment of a trouble diagnosing apparatus for an exhaust-gas recirculation system according to the present invention.

FIG. 1 illustrates a structure of an internal combustion engine incorporating an apparatus for diagnosing trouble in an EGR system according to the present invention. In this drawing, reference numeral 1 denotes an internal combustion engine; 2 an exhaust manifold; 3 an intake manifold; 4 an intake duct; 5 a throttle valve provided in the intake duct; 6 a pressure sensor for the intake duct; 7 a fuel-injection valve attached to a branch of the intake manifold 3; 8 an EGR passage communicating the exhaust manifold 2 to the intake manifold 3; 9 an EGR control valve provided in the EGR passage 8; and 10 a control circuit (engine control unit: ECU). Exhaust gas in the exhaust manifold 2 is recirculated into the intake manifold 3 via the EGR passage 8 when the EGR control valve 9 is open.

The control circuit 10 is constituted, for example, by a microcomputer including a ROM (read-only-memory) 12, a RAM (random-access-memory) 13, a CPU (central processing unit) 14, an input port 15 and an output port 16, each connected with the others by a two-way bus. In the EGR control valve 9, a lift sensor 30 is provided for detecting the opening degree of a valve body. A value detected by the lift sensor 30 is input to the input port 15 via an A/D converter 18. An intake temperature sensor 19 is provided in the intake duct 4. A value THA detected by the intake temperature sensor 19 is input to the input port 15 via an A/D converter 20. A sensor 21 for detecting an opening degree of the throttle valve 5 is connected to the throttle valve 5. A value TA detected by the throttle opening degree sensor 21 is input to the input port 15 via an A/D converter 22.

The pressure sensor 6 is attached to a surge tank (intake manifold 3) provided downstream of the throttle valve 5. A value PA detected by the pressure sensor 6 is input to the input port 15 via an A/D converter 29. A water temperature sensor 23 is attached to the engine body 1, for detecting the temperature of the water for cooling the engine. A value THW detected by the water temperature sensor 23 is input to the input port 15 via an A/D converter 24. Further, a rotational speed sensor 25 is connected to the input port 15, for issuing an output signal representing a rotational speed NE of the engine. The output port 16 is connected, on one hand, to the fuel-injection valve 7 and a negative pressure control valve 50 corresponding thereto via driver circuits 26, 26' and, on the other hand, to an abnormality lamp 28 via driving circuit 27.

In this embodiment, the negative pressure control valve 50 is a solenoid valve constituted by a solenoid 51, on-off valves 52, 53 and a negative pressure introduction duct 54. The negative pressure introduction duct 54 is open to the atmospheric pressure P via the on-off valve 52 and connected to a source of a negative pressure P3 via the on-off valve 53. The ON/OFF control of the on-off valves 52, 53 is conducted in accordance with ON/OFF signals (duty signals) input to the solenoid 51 via the driver circuit 26. According to the ON-OFF control of the on-off valves 52, 53, the regulated negative pressure $P_2$ is introduced into a negative pressure chamber 90 of the EGR control valve 9.

The interior of the EGR control valve 9 is partitioned by a diaphragm 91 into the negative pressure chamber 90 and an atmospheric pressure chamber 94. A shaft 33 is fixed to the diaphragm 91. In the interior of the negative chamber 90, a spring 92 is provided for biasing the shaft 33 towards the atmospheric pressure chamber 94. The aforesaid lift sensor 30 is attached this EGR control valve 9 and provided with a variable resistor 31 ad a brush 32 fixed to the shaft 33 to slide together with the shaft 33. When the shaft 33 moves upward and downward by the control of the negative pressure control valve 50, the position of the variable resistor 31 relative to the brush 32 varies to change the voltage value detected by the brush 32. An output detected by the brush 32 is sent to the input port 15 via the A/D converter 18.

A valve body 93 is attached to a free end of the shaft 33, for opening/closing a valve seat 83 provided midway in the EGR passage 8. Also in this embodiment, a metering orifice 80 is provided in the EGR passage of the valve seat 83 closer to the exhaust manifold 2, for maintaining the flow rate of exhaust gas constant. A negative pressure chamber 81 is defined by the EGR passage 8 between this metering orifice 80 and the valve seat 83. On the other hand, an intake side EGR passage 82 is defined by the EGR passage 8 between the valve seat 83 and the intake manifold 3. Also, a pressure sensor 17 is provided in the negative pressure chamber 81 of this embodiment, and an output side of the pressure sensor 17 is connected to the input port 15 via an A/D converter 34.

According to the apparatus 1 for diagnosing trouble in the exhaust-gas recirculation system thus structured, the control circuit 10 drives the negative pressure control valve 50 in a feedback manner in accordance with a lift amount of the shaft 33 detected by the lift sensor 30 so that a target lift value corresponding to the operation state of the internal combustion engine is obtained. Then, the negative pressure regulated to $P_2$ is guided to the EGR control valve 9 in accordance with ON/OFF signals (duty signals) to the solenoid 51, which causes the valve body 93 to open whereby exhaust gas is guided to the intake manifold 3 via the EGR passage 8 from the exhaust manifold 2. Thus, EGR is conducted.

In this embodiment, since the metering orifice is provided upstream of the valve seat 83 in the EGR passage 8, for detecting a flow rate of exhaust gas, the negative pressure is generated in the negative pressure chamber 81 in accordance with the flow rate of the exhaust gas during EGR when the EGR control valve 9 is in a normal state, which negative pressure is detected by the pressure sensor 17.

In this embodiment, it is also possible to detect trouble in the EGR control valve 9 by monitoring a lift amount of the valve body 93 detected by the lift sensor 30. When the EGR control valve 9 is normal, it is possible to detect the clogging of the EGR passage 8 by monitoring the pressure in the negative pressure chamber 81 detected by the pressure sensor 17. In addition, according to this embodiment, it is possible to determine whether this clogging occurs upstream or downstream of the EGR control valve 9.

The determination whether the clogging of the EGR passage 8 occurs upstream or downstream of the EGR control valve 9 is conducted as follows. That is, when the operation state of the internal combustion engine in an operation zone wherein an amount of EGR is large, the negative pressure in the negative pressure chamber 81 increases by the metering orifice 80 if the EGR control valve 9 is normal. Accordingly, the generation of clogging downstream of the EGR control valve 9 can be detected by the reduction of negative pressure in the operation zone wherein the amount of EGR is large.

Centrality, when the internal combustion engine is in the operation zone wherein the amount of EGR is small, if the EGR control valve 9 is normal, the negative pressure is maintained at a lower level even if the metering orifice 80 exists. Accordingly, the generation of clogging upstream of the negative pressure chamber 81, i.e., upstream of the EGR control valve 9 can be detected by the increase of negative pressure in the operation zone wherein the amount of EGR is small.

In this regard, if the metering orifice 80 is provided on the exhaust side of the EGR control valve 9, the pulsation of exhaust gas in the exhaust manifold 2 is suppressed to minimize the pulsation of pressure in the negative pressure chamber 81, whereby the pressure in the negative pressure chamber 81 can be accurately detected.

Figure 2A:
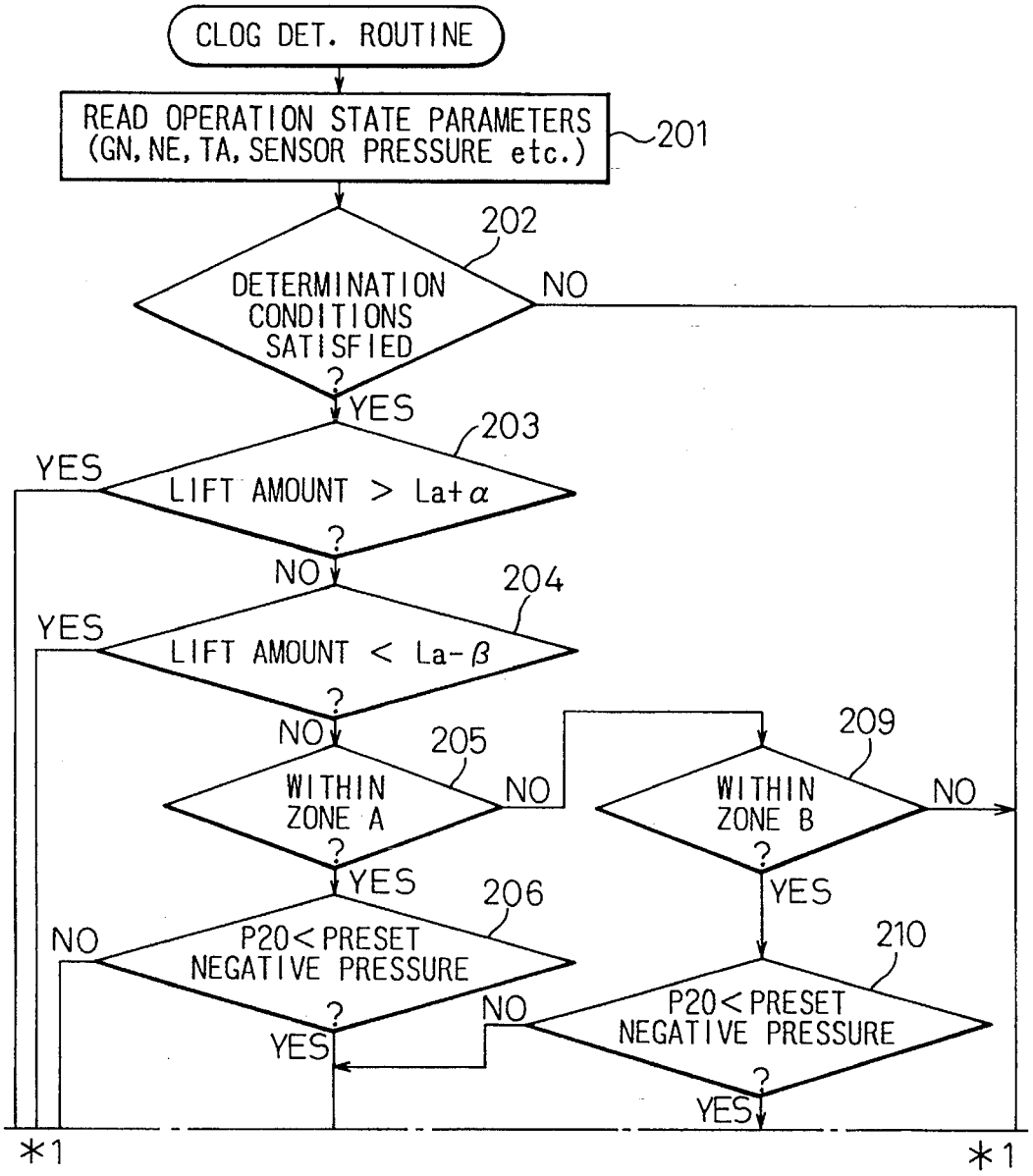
FIGS. 2A and 2B are a flow-chart illustrating one example of a series of steps for diagnosing trouble in the exhaust-gas recirculation system in the embodiment shown in FIG. 1.
Figure 2B:
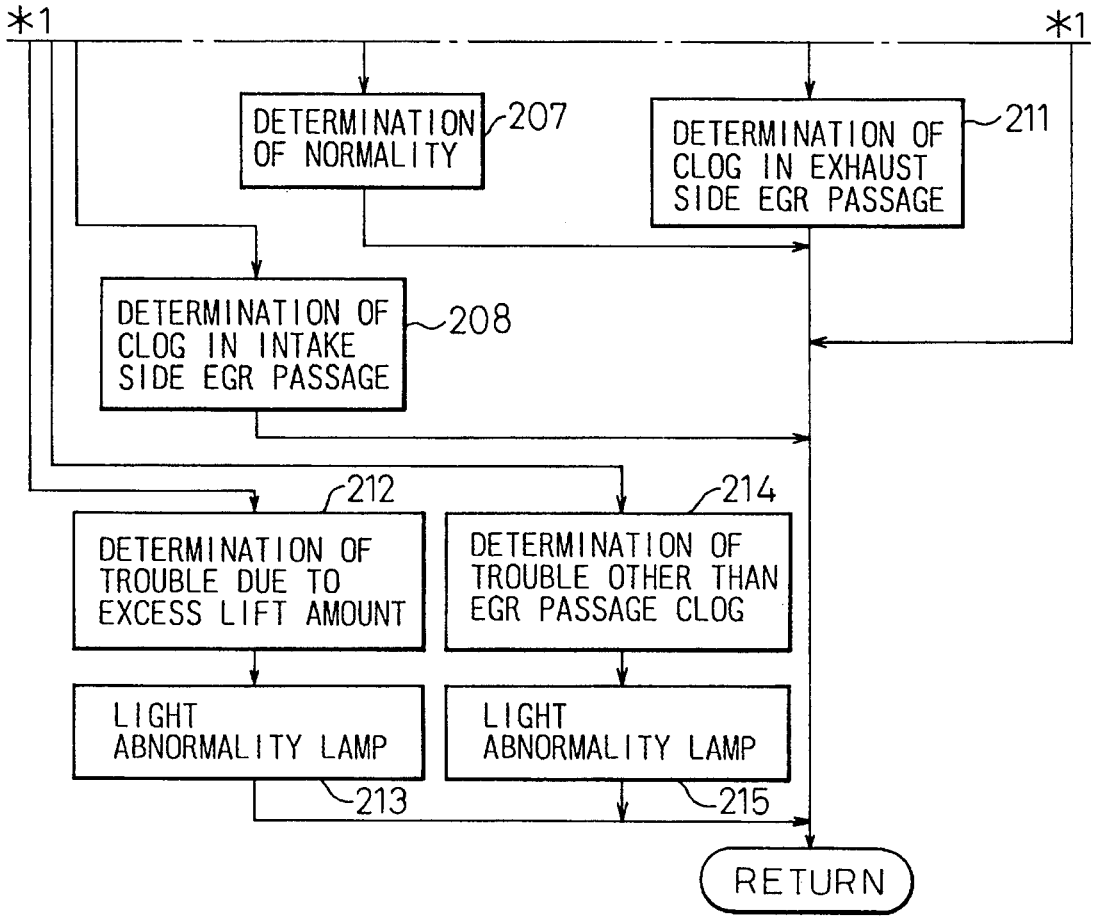

Next, a procedure for determining trouble in the EGR control valve 9 and the clogging of the EGR passage 8 will be explained with reference to a flow chart shown in FIGS. 2A and 2B.

At step 201, the operation state parameters of the engine (for example, an engine load GN (which can be calculated from an amount of air per one rotation of engine), an engine rotational speed NE, an opening degree of throttle TA, a sensor pressure P20, an intake pressure PA and a water temperature THW) are read. At step 202, it is determined whether or not determination conditions for the trouble of the EGR control valve 9 and the clogging of the EGR passage 8 are satisfied. The determination conditions are as follows (note GN1, GN2, Ne1, Ne2, TA1 and TA2 represent constants);

(1) the load is in a predetermined range (GN1<GN<GN2), (2) the rotational speed is in a predetermined range (Ne1<NE<Ne2), (3) the opening degree of throttle is predetermined range (TA1<TA<TA2), (4) the engine is not in a transfer state (an acceleration ΔTA of the opening degree of throttle is less than a predetermined value), (5) the lift sensor is normal (not broken), and (6) all of the above conditions are continuously satisfied for at least a predetermined period.

If these conditions defined by items (1) through (6) are not satisfied at step 202, the routine is finished, while if they are satisfied, the control proceeds to step 203.

At step 203, it is determined whether or not the lift amount of the valve body 93 of the EGR control valve 9 detected by the lift sensor 30 is larger than a target lift amount La plus a predetermined value α. In a case of the lift amount>La+α, the control proceeds to step 212 to determine the trouble of EGR control valve 9 wherein the lift amount thereof is too large, then to step 213 at which the abnormality lamp 28 is lit and thereafter the routine is finished. On the other hand, in a case of the lift amount≦La+α, the control proceeds to step 204.

At step 204, it is determined whether or not the lift amount of the valve body 93 of the EGR control valve 9 detected by the lift sensor 30 is smaller than the target lift amount La minus a predetermined value β. In a case of the lift amount<La−β, the control proceeds to step 214 to determine the trouble in the ERG control valve 9 due to a cause other than the clogging of the EGR passage, then to step 215 at which the abnormality lamp 28 is lit and the routine is finished. On the other hand, in a case of the lift amount≧La−β, the control proceeds to step 205.

Figure 3:
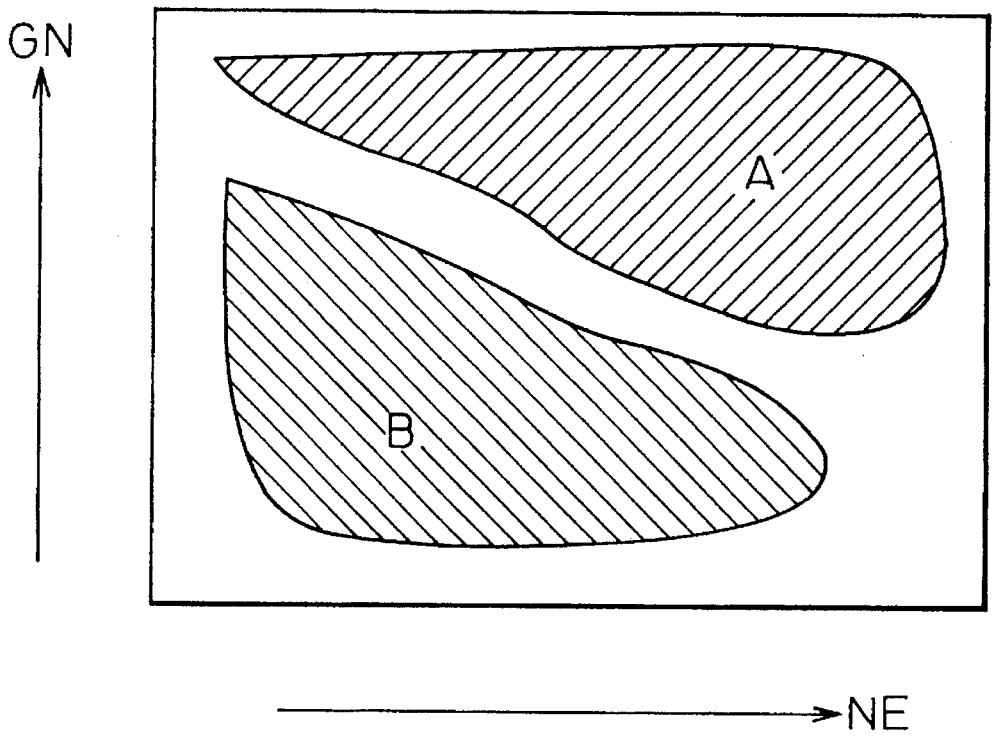
FIG. 3 is a chart for explaining zones A and B on the coordinates wherein the abscissa represents a rotational speed of engine and the ordinate represents a load.

At step 205, it is determined whether or not the operation state of the engine is in zone A. In the zone A, the flow rate of EGR (not the EGR ratio) is relatively large and the pressure P20 in the negative pressure chamber 81 is lower (i.e., larger as a negative pressure) than the predetermined pressure (preset negative pressure) if the EGR system is normal. The zone A is shown by hatching in the operation state map of engine in FIG. 3, and represents the rotational speed of engine NE and the engine load GN. Contrarily thereto, in another zone B, shown by hatching in FIG. 3, the flow rate of EGR is relatively small and the pressure P20 in the negative pressure chamber 81 is higher (i.e., smaller as a negative pressure) than the predetermined pressure (preset negative pressure) if the EGR system is normal.

If it is determined that the operation state of engine is in the zone A at step 205, the control proceeds to step 206 at which it is determined whether or not the pressure P20 in the negative pressure chamber 81 detected by the pressure sensor 17 is smaller than the abovementioned preset negative pressure. If P20 is larger than or equal to the preset negative pressure, the control proceeds to step 207 at which it is determined that the EGR system is normal and the routine is finished. On the other hand, if P20 is smaller than the preset negative pressure, the control proceeds to step 208 to determine that the clogging occurs in the intake side EGR passage 82 and finish the routine.

If it is determined that the operation state of engine is not in the zone A at step 205, the control proceeds to step 209 to determine whether or not the operation state of engine is in the zone B. If it is determined that the operation state of engine is into in the zone B at step 209, the routine is finished without the determination of trouble of the EGR system. On the other hand, if it is determined that the operation state of engine is in the zone B at step 209, the control proceeds to step 210 at which it is determined whether or not the pressure P20 in the negative pressure chamber 81 detected by the pressure sensor 17 is smaller than the above-mentioned preset negative pressure. If P20 is smaller than the preset negative pressure, the control proceeds to step 207 at which it is determined that the EGR system is normal and the routine is finished. On the other hand, if P20 is larger than or equal to the preset negative pressure, the control proceeds to step 211 at which it is determined that the clogging occurs in the exhaust side EGR passage 8 and the routine is finished.

In this regard, when the detected pressures are determined to be larger or smaller than the preset value in steps 212 and 214, respectively, the abnormality lamp 28 is lit to warn the driver and the code of the abnormality in the EGR system due to the larger or smaller pressure is memorized. Also, when the clogging of EGR passage 8 is detected, the abnormality lamp 28 may be lit and the portion clogged may be memorized by a specified code.

According to the embodiment of an apparatus for diagnosing the trouble of an exhaust-gas recirculation system described above, since the flow rate of EGR in the EGR passage is directly detected, it is possible to more accurately conduct the trouble detection compared to that using the exhaust gas temperature.

Figure 4:
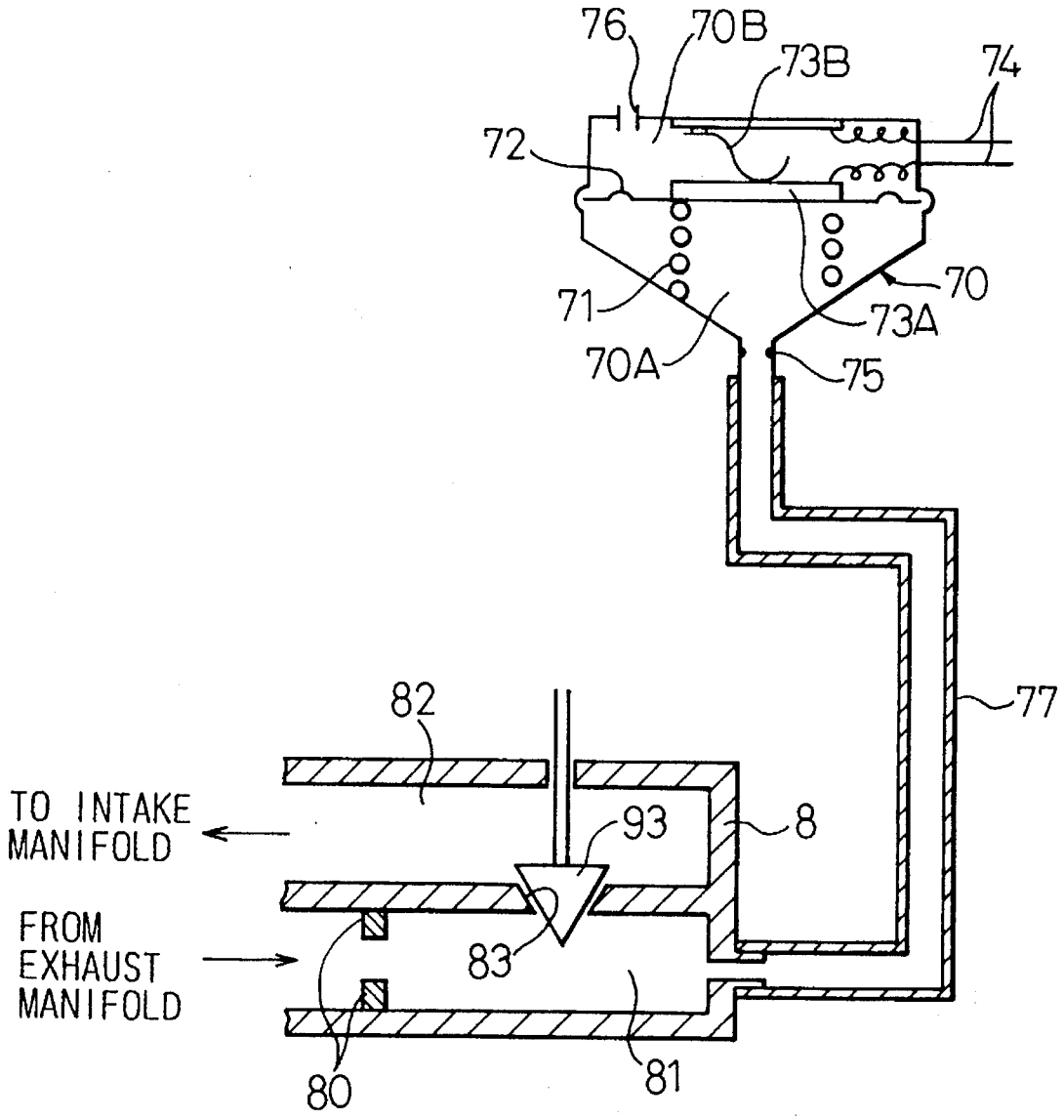
FIG. 4 is an enlarged view of the part of FIG. 1 when a pressure sensor is replaced by an ON-OFF switch.

In the embodiment described above, to detect the clogging of EGR passage 8, the negative pressure in the negative pressure chamber 81 of the EGR passage 8 is detected by the pressure sensor 17. However, it is possible to use a pressure switch, instead of this pressure sensor 17, which is capable of being switched between ON/OFF states while using the above-mentioned preset pressure as a neutral point. FIG. 4 illustrates an embodiment wherein an pressure switch 70 is connected to the negative pressure chamber 81 of the EGR passage 8.

In the embodiment shown in FIG. 4, the pressure switch 70 is connected via a pressure introduction pipe 77 to the negative pressure chamber 81 defined by the metering orifice 80 in the EGR passage 8. The pressure switch 70 is partitioned by a diaphragm 72 into two chambers; a negative pressure chamber 70A and an atmospheric pressure chamber 70B. The negative pressure chamber 70A is connected to the negative pressure chamber 81 via the pressure introduction pipe 77 and has an orifice 75 at an entrance thereof. In the interior of the negative pressure chamber 70A, a spring 71 is provided to bias the diaphragm 72 toward the atmospheric pressure chamber 70B. The atmospheric pressure chamber 70B is open to the atmosphere through a vent 76, and it has, in the interior thereof, a first conductive piece 73A and a second conductive piece 73B normally connected to the first conductive piece 73A, which pieces are connected to the control circuit 10 already described in relation to FIG. 1 via lead wires 74, respectively.

Figure 5A:
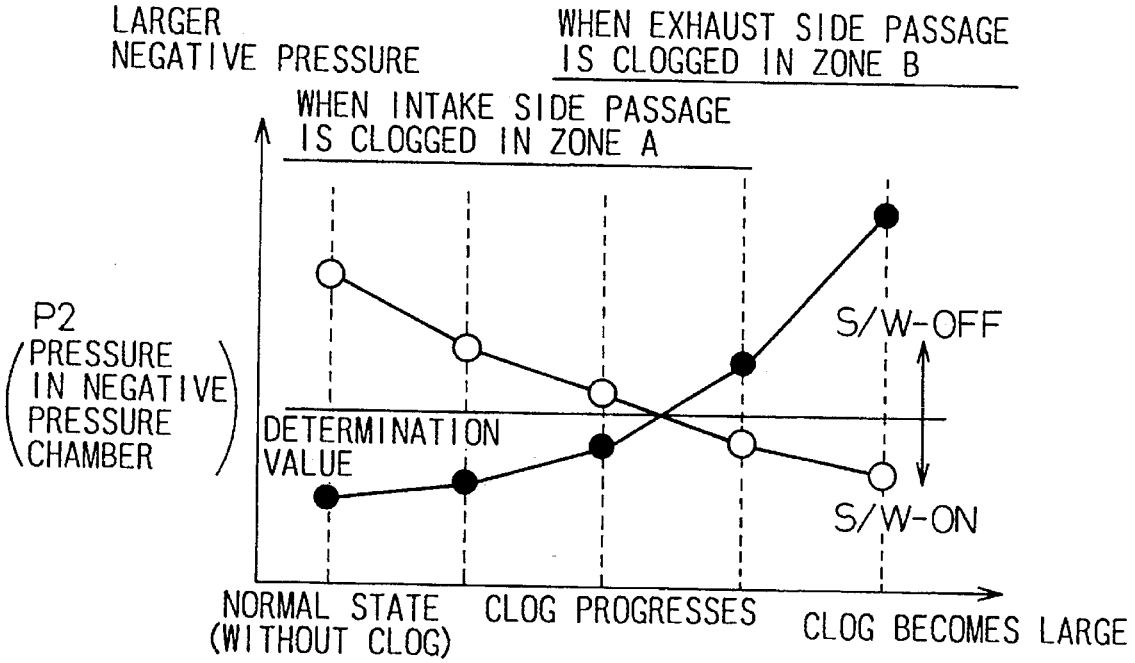
FIG. 5A is a characterized curve illustrating the pressure variation in a negative pressure chamber of FIG. 4 when clogging on the intake side and the exhaust side, respectively, is growing.
Figure 5B:
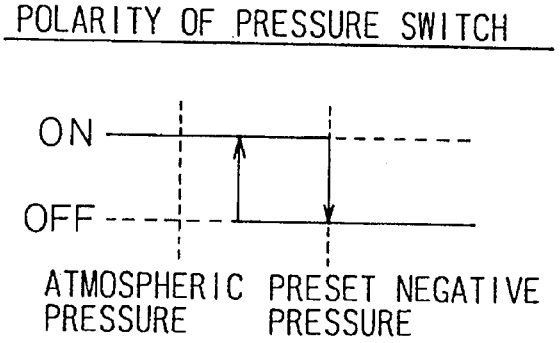
FIG. 5B is a chart for explaining ON/OFF characteristic of a pressure switch of FIG. 4.

In this embodiment, the pressure switch 70 is normally in ON state wherein the pieces 73A and 73B are connected to each other, while being in OFF state if the diaphragm 72 shifts toward the negative pressure chamber 70A by a distance longer than a predetermined length against the spring 71 when the negative pressure in the negative pressure chamber 81 increases to exceed the preset negative pressure. FIG. 5B shows the ON/OFF characteristic of this pressure switch 70, which has a hysteresis wherein the pressure switch 70 is switched from ON to OFF when the negative pressure in the negative pressure chamber 81 exceeds the preset negative pressure, and switched from OFF to ON when the negative pressure in the negative pressure chamber 81 falls to a value smaller than the preset negative pressure.

The preset negative pressure at which the pressure switch 70 is switched from ON to OFF can be determined by selecting the spring 71. FIG. 5A shows the variation of pressure (negative pressure) in the negative pressure chamber 81 when the clogging occurs in the EGR passage 8. As described before, when the EGR system is normal, the negative pressure in the negative pressure chamber 81 is relatively large, as shown by small circles, if the operation state of the engine is in the zone A; while the negative pressure in the negative pressure chamber 81 is relatively small, as shown by circular dots, if the operation state of engine is in the zone B. When the clogging occurs in the EGR passage 8 downstream of the EGR control valve 9 (closer to the intake side), the negative pressure in the negative pressure chamber 81 falls as the clogging degree becomes larger. Contrarily, if the clogging occurs in the EGR passage 8 upstream of the EGR control valve 9 (closer to the exhaust side), the negative pressure in the negative pressure chamber 81 increases as the clogging degree becomes larger.

Accordingly, a negative pressure to be preset in the pressure switch 70 (determination value) may be selected as a value corresponding to a pressure in the negative pressure chamber 81 in the vicinity of a point in FIG. 5A at which a magnitude relationship between the pressure in the negative pressure chamber when the operation state of engine is in the zone A and that when the operation state of engine is in the zone B is reversed.

Figure 6A:
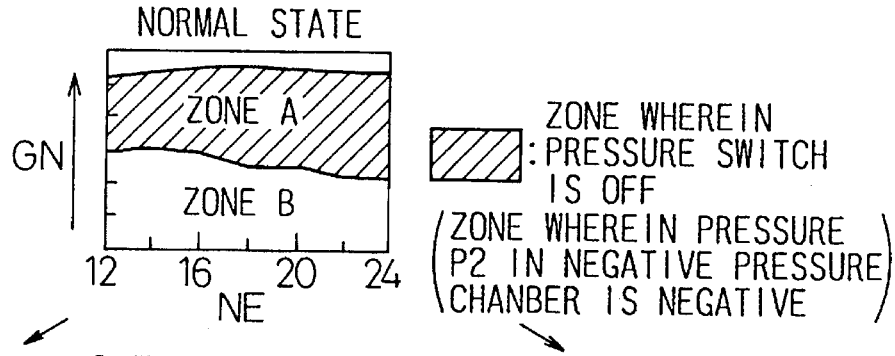
FIG. 6A is a chart illustrating a zone wherein the pressure switch of FIG. 4 is OFF when there is no clogging in the EGR passage.
Figure 6B:
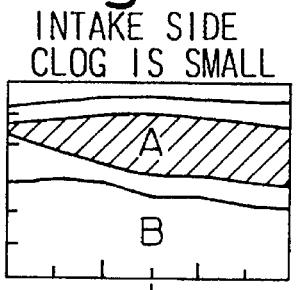
FIGS. 6B through 6D are charts illustrating the variation of the zone wherein the pressure switch of FIG. 4 is OFF when the clogging generated on the intake side of the EGR passage is growing.
Figure 6E:
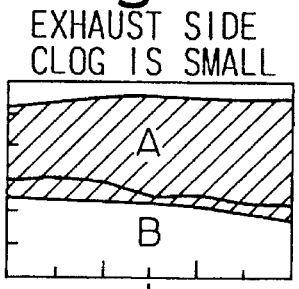
FIGS. 6E through 6G are charts illustrating the variation of the zone wherein the pressure switch of FIG. 4 is OFF when the clogging generated on the exhaust side of the EGR passage is growing.
Figure 6C:
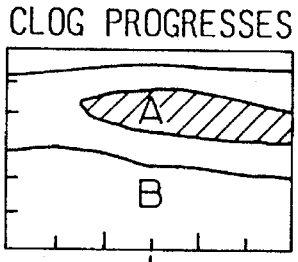
Figure 6F:
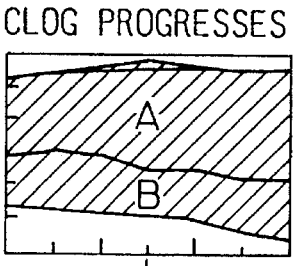
Figure 6D:
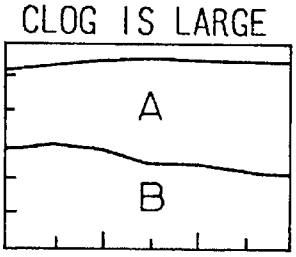
Figure 6G:
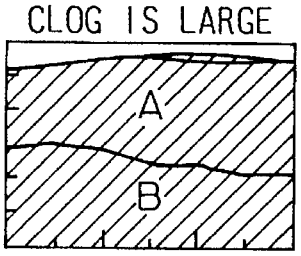

FIGS. 6A to 6G explain the variation of OFF state of the pressure switch 70 which is switched from ON state to OFF state as stated above, in accordance with the degree of clogging of the EGR passage 8. In the normal state when no clogging occurs in the EGR passage 8, the pressure switch 70 is substantially in the OFF state in the zone A and in the ON sate in the zone B as shown in FIG. 6A. When the clogging occurs in the EGR passage 8 closer to the intake side which has been maintained in the normal state, an OFF zone of the pressure switch 70 in the zone A is narrowed as shown in FIG. 6B, and the more the degree of clogging in the EGR passage 8 closer to the intake side, the narrower the OFF zone in the zone A as shown in FIGS. 6C and 6D. While, if the clogging occurs in the EGR passage 8 closer to the exhaust side which has been maintained in the normal state, an OFF zone of the pressure switch 70 extends to the zone B, as shown in FIG. 6E, and the more the degree of clogging in the EGR passage 8 closer to the exhaust side, the narrower the OFF zone in the zone B as shown in FIGS. 6F and 6G.

Accordingly, by detecting the variation of the OFF zone of the pressure switch 70 in the zone A, it is possible to detect the degree of clogging in the EGR passage 8 closer to the intake side, and, on the other hand, by detecting the variation of the OFF zone of the pressure switch 70 in the zone B, it is possible to detect the degree of clogging in the EGR passage 8 closer to the exhaust side.

Figure 7A:
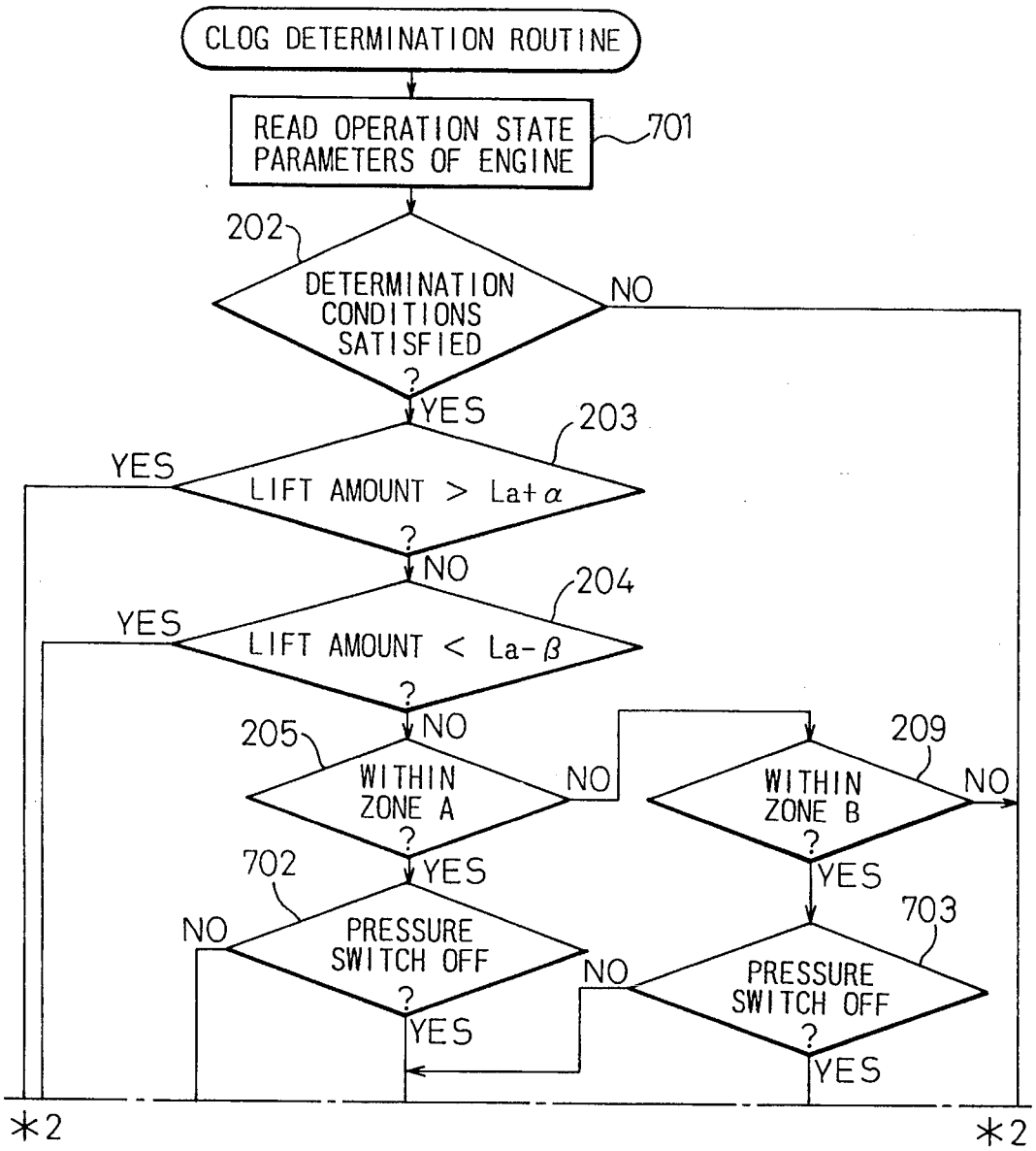
FIGS. 7A and 7B are a flow chart illustrating one example of a series of steps for diagnosing trouble in the exhaust-gas recirculation system in the embodiment shown in FIG. 4.
Figure 7B:
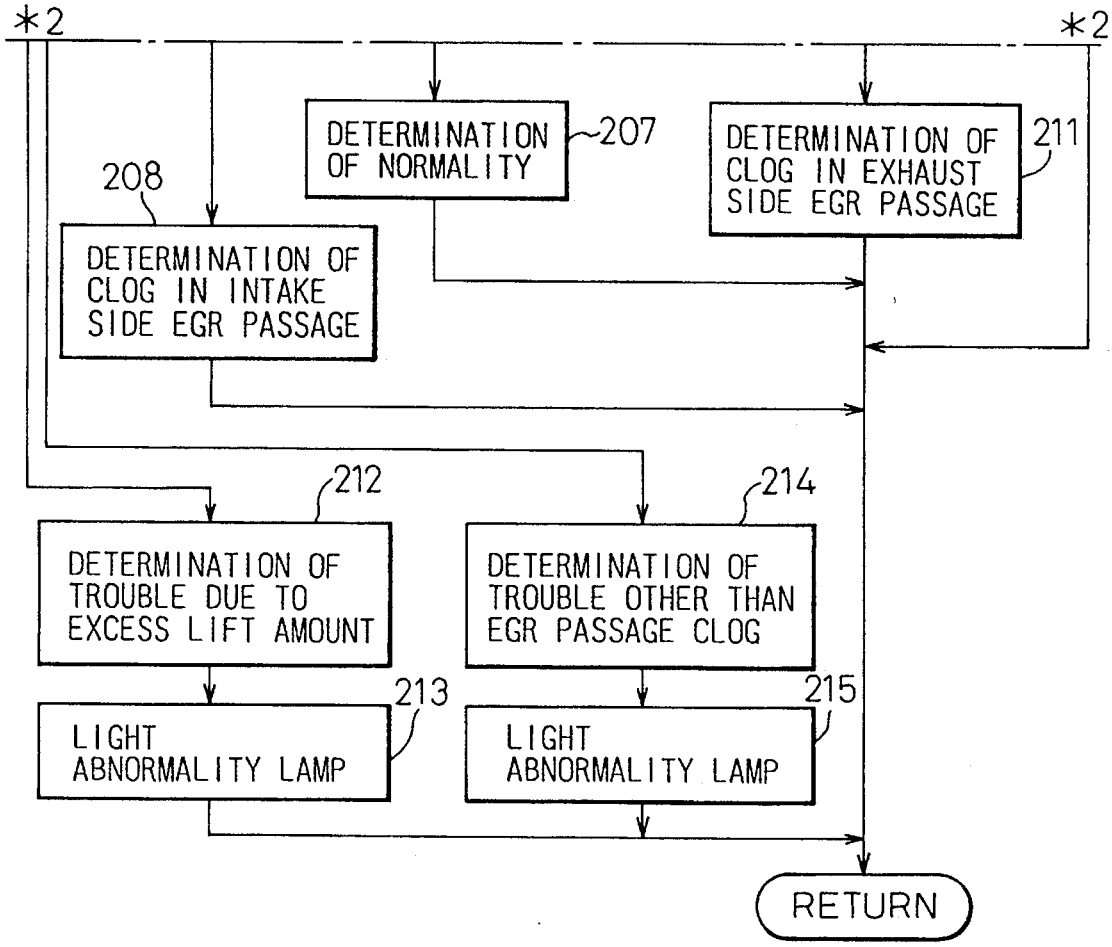

Next, the procedure for the determination of trouble in the EGR control valve 9 and the degree of clogging in the EGR passage 8 closer to the exhaust side will be explained with reference to a flow chart shown in FIGS. 7A and 7B. In this regard, the same numbers are used for designating the same steps as in FIGS. 2A and 2B.

At step 701, operation state parameters of the engine (for example, an engine load GN (which can be calculated from an amount of air per one rotation of engine), an engine rotational speed NE, an opening degree of throttle TA, an intake pressure PA and a water temperature THW) are read. At step 202, it is determined whether or not determination conditions for trouble in the EGR control valve 9 and the clogging of the EGR passage 8 are satisfied. The determination conditions are as stated before.

If the determination conditions are not satisfied, the routine is finished. Contrarily, if the determination conditions are satisfied, it is determined whether or not the lift amount of the valve body 93 of the EGR control valve 9 detected by the lift sensor 30 is proper at steps 203 and 204. If the abnormal state of lift amount>La+α is detected, it is determined at step 212 that the trouble occurs wherein the lift amount of the EGR control valve 9 is excessive, and the abnormality lamp 28 is lit at step 213. While, if the abnormal state of lift amount<LA−β is detected, the control proceeds to step 214 at which it is determined that the trouble occurs in the EGR system other than the clogging of EGR passage 8, and then to step 215 at which the abnormality lamp 28 is lit.

On the other hand, when the lift amount of the EGR control valve 9 is proper, the control proceeds to step 205 at which it is determined whether or not the operation state of engine is in the zone A. If it is determined that the operation state is in the zone A, the control proceeds to step 702 at which it is determined whether or not the pressure switch 70 is OFF. If it is determined that the pressure switch 70 is OFF, the control proceeds to step 207 at which the routine is finished after it is determined that the EGR system is normal. While, if the pressure switch is maintained in ON state, the control proceeds to step 208 at which the routine is finished after it is determined that the clogging occurs in the intake side EGR passage 82.

If it is determined at step 205 that the operation state of the engine is not in the zone A, the control proceeds to step 209 at which it is determined whether or not the operation state of engine is in the zone B. If it is determined at step 209 that the operation state of engine is not in the zone B, the routine is finished without conducting a determination of the trouble in the EGR system. While, if it is determined that the operation state of engine is in the Zone B, the control proceeds to step 703 at which it is determined whether or not the pressure switch 70 is OFF. If it is determined that the pressure switch 70 is ON, the control proceeds to step 207 at which the routine is finished after it is determined that the EGR system is normal. On the other hand, if the pressure switch 70 is OFF, the control proceeds to step 211 at which the routine is finished after it is determined that the clogging occurs in the exhaust side EGR passage 8.

In such a manner, even if the ON/OFF type pressure switch 70 is used instead of the pressure sensor 17, it is possible to detect whether or not the trouble occurs in the EGR control valve 9 and whether the clogging occurs in the EGR passage 8 upstream or downstream of the EGR control valve 9. When the ON/OFF type pressure switch 70 with a single contact is used instead of the pressure sensor 17, it is possible to reduce the production cost of the apparatus for diagnosing trouble in the exhaust-gas recirculation system because the switch 70 is more inexpensive than the pressure sensor 17, and the input circuit for the control circuit 10 and the wire harness can be simplified. The preset pressure of the pressure switch 70 is adjustable by varying a spring constant of the spring 92, and the negative pressure value to be generated in the negative pressure chamber 81 is adjustable by varying a diameter of the metering orifice 80, which enhances the degree of freedom for adaptation. In addition, when the ON/OFF characteristic of the pressure switch 70 is defined to be ON on the atmospheric pressure side (the positive pressure side as in the preceding embodiment, a separate circuit for exclusively detecting the wire breakage of the pressure switch 70 is unnecessary and it is possible, immediately after the electric source is input to the control circuit 10, to detect whether or not the wire breakage of the pressure switch 70 occurs.

Next, a further embodiment will be explained, wherein the detection accuracy of the apparatus for diagnosing trouble in the exhaust-gas recirculation system is improved by the use of the pressure switch 70 having a structure as shown in FIG. 4.

Figure 8A:
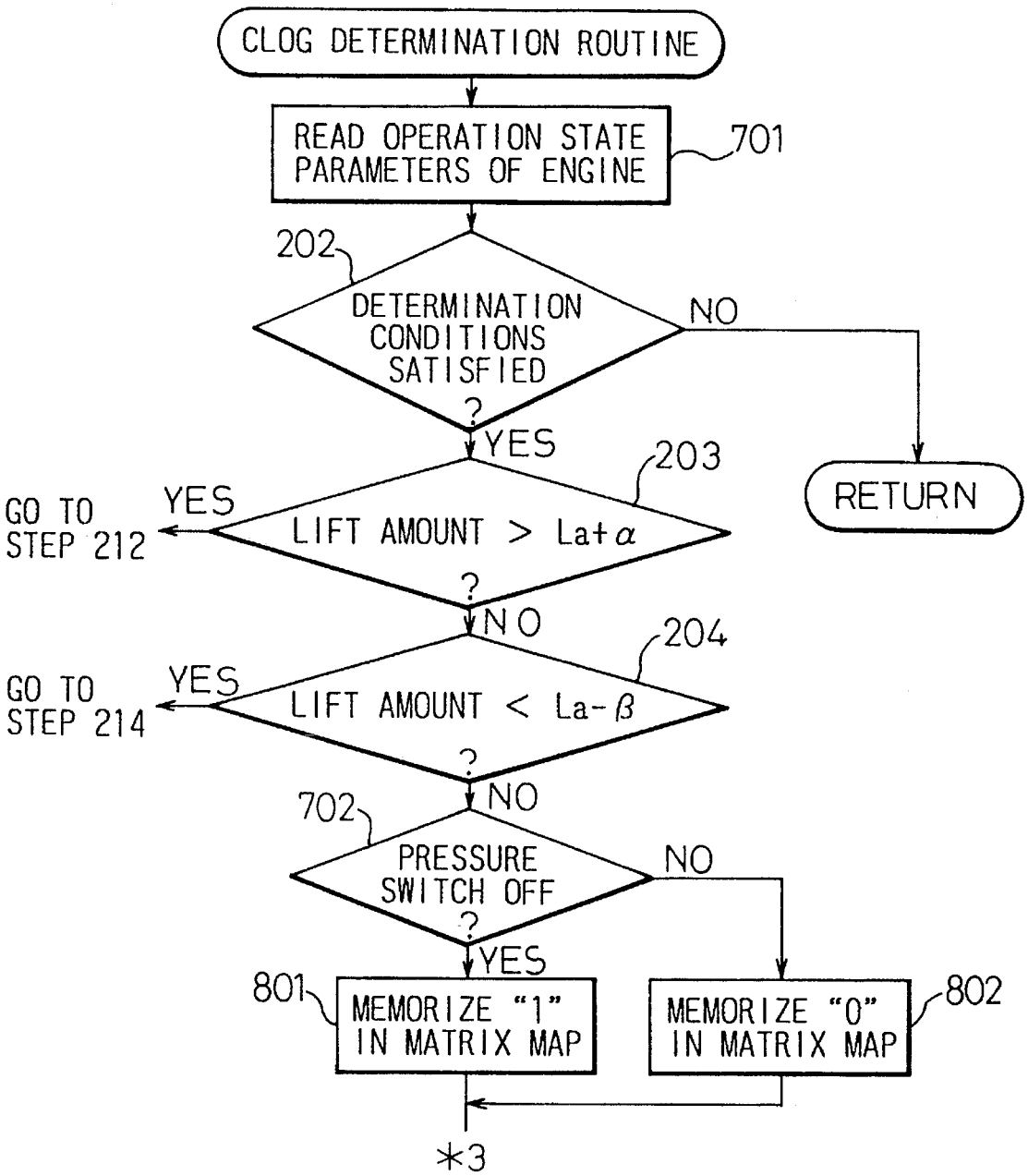
FIGS. 8A and 8B are a flow chart illustrating another example of a series of steps for diagnosing trouble in the exhaust-gas recirculation system in the embodiment shown in FIG. 4.
Figure 8B:
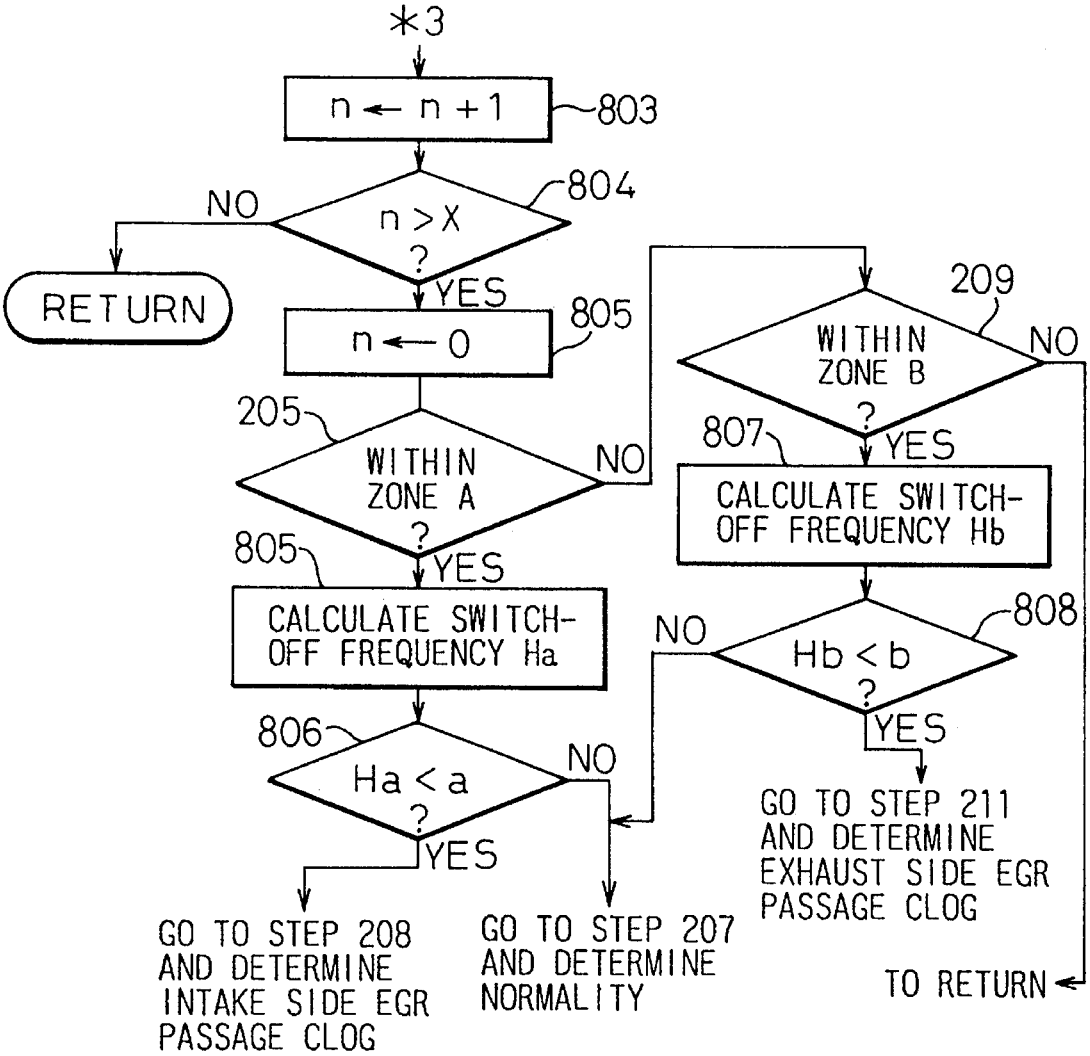

FIGS. 8A and 8B are a flow chart for illustrating a procedure for improving the detection accuracy of the apparatus for diagnosing the trouble of the exhaust-gas recirculation system, wherein the same step numbers are used for denoting the same steps as already explained with reference to FIGS. 7A and 7B.

At step 701, parameters for representing operation states of engine are read, and at step 202, it is determined whether or not the conditions for determining the trouble of the EGR control valve 9 and the clogging of the EGR passage 8 are satisfied. The conditions for the determination are as described before, and if the conditions are not satisfied, the routine is finished.

When the conditions are satisfied, it is determined, at steps 203 and 204, whether or not the lift amount of the valve body 93 of the EGR control valve 9 detected by the lift sensor 30 is proper. When there is an abnormality of lift amount>La+α, it is determined at step 212 that the trouble occurs wherein the lift amount of the EGR valve 9 exceeds the predetermined value. Then, the abnormality lamp 28 is lit at step 213. While, when there is an abnormality of lift amount<La−β, the control proceeds to step 214 at which it is determined that the trouble occurs in the EGR system other than the clogging of the EGR passage 8, and thereafter proceeds to step 215 at which the abnormality lamp 28 is lit.

On the other hand, when the lift amount of the EGR control valve 9 is proper, the control proceeds to step 702 at which it is determined whether or not the pressure switch 70 is OFF. If the pressure switch 70 is OFF, the control proceeds to step 801 at which a value "1" representing the apparatus if OFF is memorized in a matrix map, and then proceeds to step 803. While, if the pressure switch is maintained at ON, the control proceeds to step 802 at which a value "0" representing the apparatus is maintained at ON is memorized in the matrix map, and then proceeds to step 803. At step 803, the number n of memories memorized in the matrix map increase by one.

At the subsequent step 804, it is determined whether or not the number n memorized in the matrix map exceeds a predetermined number X. In a case of n≦X, the routine is finished. In a case of n>X, the number n memorized in the matrix map is cleared at step 805, and thereafter the control proceeds to step 205 at which it is determined whether or not tile operation state of engine is in the zone A.

If it is determined that the operation state of engine is in the zone A, the control proceeds to step 805 at which the frequency Ha of the OFF states of the pressure switch 70 in the zone A is calculated. Then, at subsequent step 806, it is determined whether or not the frequency Ha of the OFF states of the pressure switch 70 is smaller than a predetermined value a. In a case of Ha≧a, the control proceeds to step 207 at which it is determined the EGR system is normal, and the routine is finished. In a case of Ha<a, the control proceeds to step 208 at which it is determined the clogging occurs in the intake side EGR passage 82, and the routine is finished.

If it is determined at step 205 that the operation state of engine is not in the zone A, the control proceeds to step 209 at which it is determined whether or not the operation state of engine is in the zone B. If it is determined at step 209 that the operation state of engine is not in the zone B, the routine is finished without determining the trouble in the EGR system. On the other hand, if it is determined at step 209 that the operation state of engine is in the zone B, the control proceeds to step 807 at which the frequency Hb of the OFF state of the pressure switch 70 in the zone B is calculated. Than, at subsequent step 808, it is determined whether or not the frequency Hb of the OFF states of the pressure switch 70 is larger than a predetermined value b. In a case of Hb≦b, the control proceeds to step 207 at which it is determined the EGR system is normal, and the routine is finished. Contrarily, in a case of Hb>b, the control proceeds to step 211 at which it is determined that the clogging occurs in the exhaust side EGR passage 8, and the routine is finished.

As stated above, according to this embodiment, it is possible to improve the detection accuracy because the trouble of the EGR control valve 9 and the clogging in the EGR passage 8 upstream or downstream of the EGR control valve 9 are detected based on the statistical treatment of the variation of ON/OFF states in the respective zories of the pressure sensor 17.

Figure 9A:
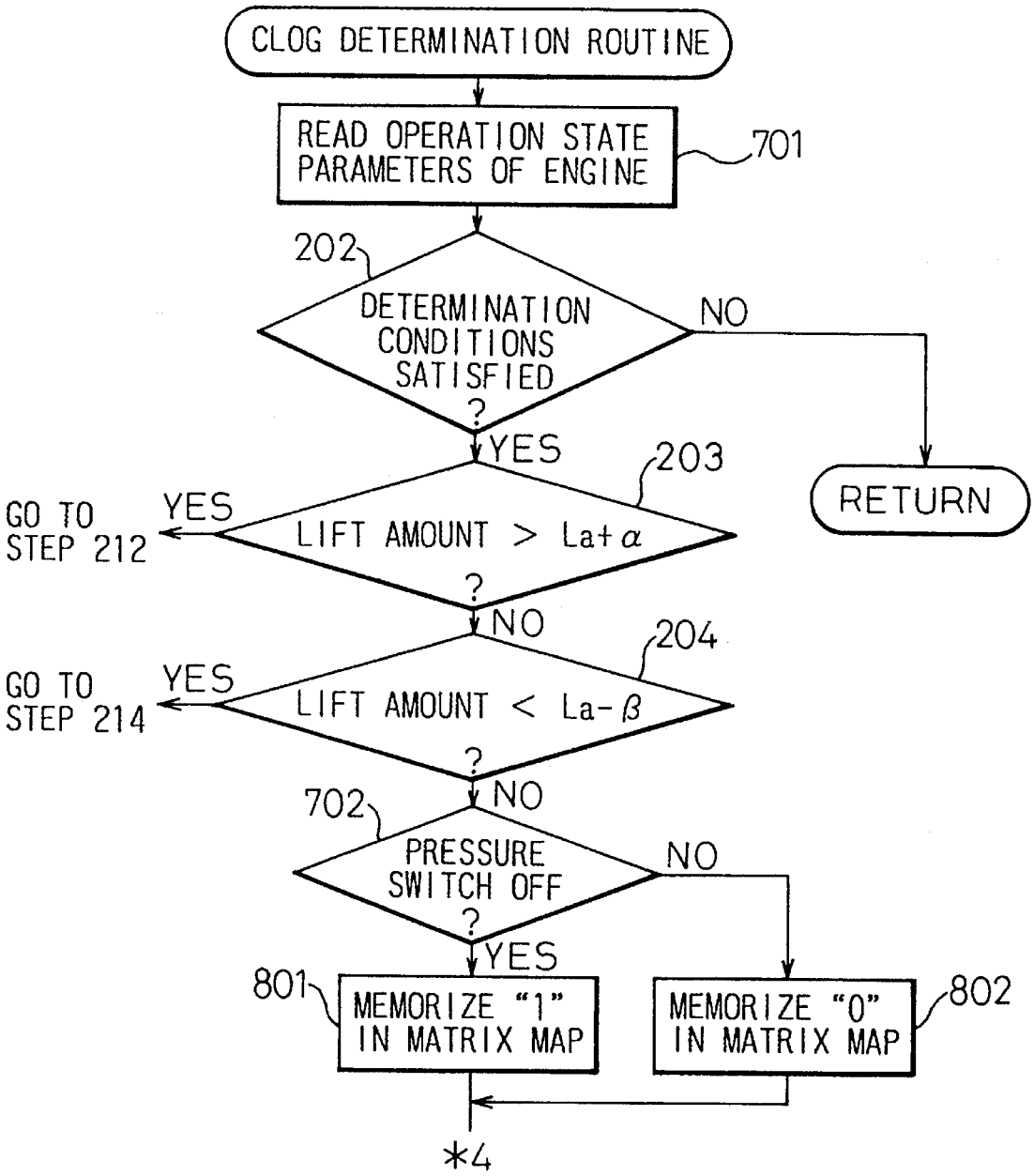
FIGS. 9A and 9B are a flow chart illustrating further example of a series of steps for diagnosing trouble in the exhaust-gas recirculation system in the embodiment shown in FIG. 4.
Figure 9B:
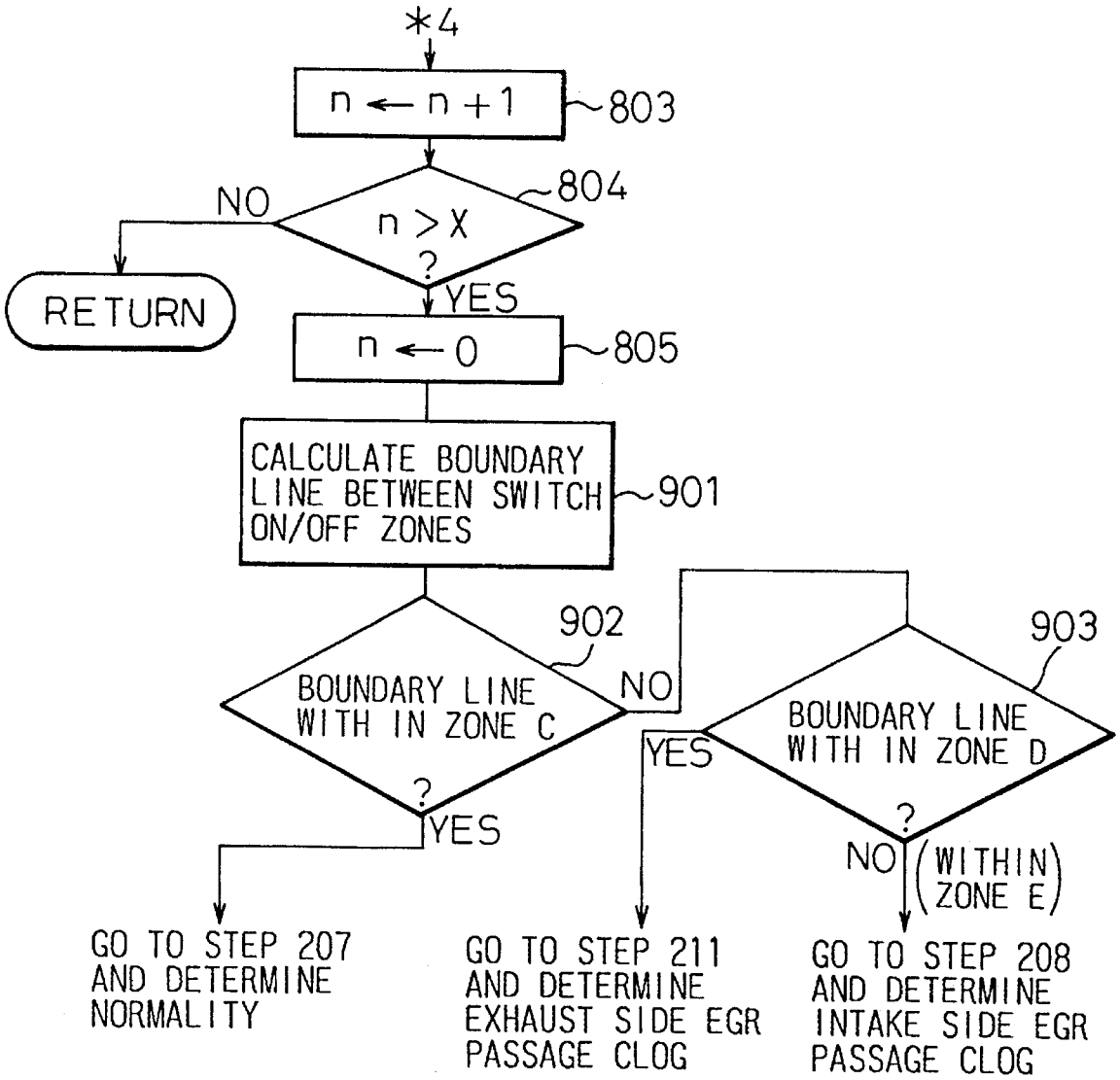

FIGS. 9A and 9B are a flow chart illustrating a still-further embodiment for improving the detection accuracy of the trouble diagnosing apparatus for the exhaust-gas recirculation system wherein the same step numbers are used for designating steps in steps 701 through 805, which are the same as those in the flow chart shown in FIG. 8 and the explanation thereof is omitted because they are almost identical to each other.

The difference between the procedure shown in FIGS. 9A and 9B and that of FIGS. 8A and 8B resides in that, in the embodiment shown in FIGS. 8A and 8B, the diagnosis for the trouble in the exhaust-gas recirculation system is conducted based on the frequency of ON/OFF states of the pressure switch 70, while in the embodiment shown in FIGS. 9A and 9B, a boundary line between ON/OFF zones in the ON/OF characteristic curve of the pressure switch 70 is detected, and the determination of abnormality and the detection of clogged position in the EGR passage 8 are conducted based on the direction and the degree of deviation of the detected boundary line from a normal state boundary line.

Figure 10:
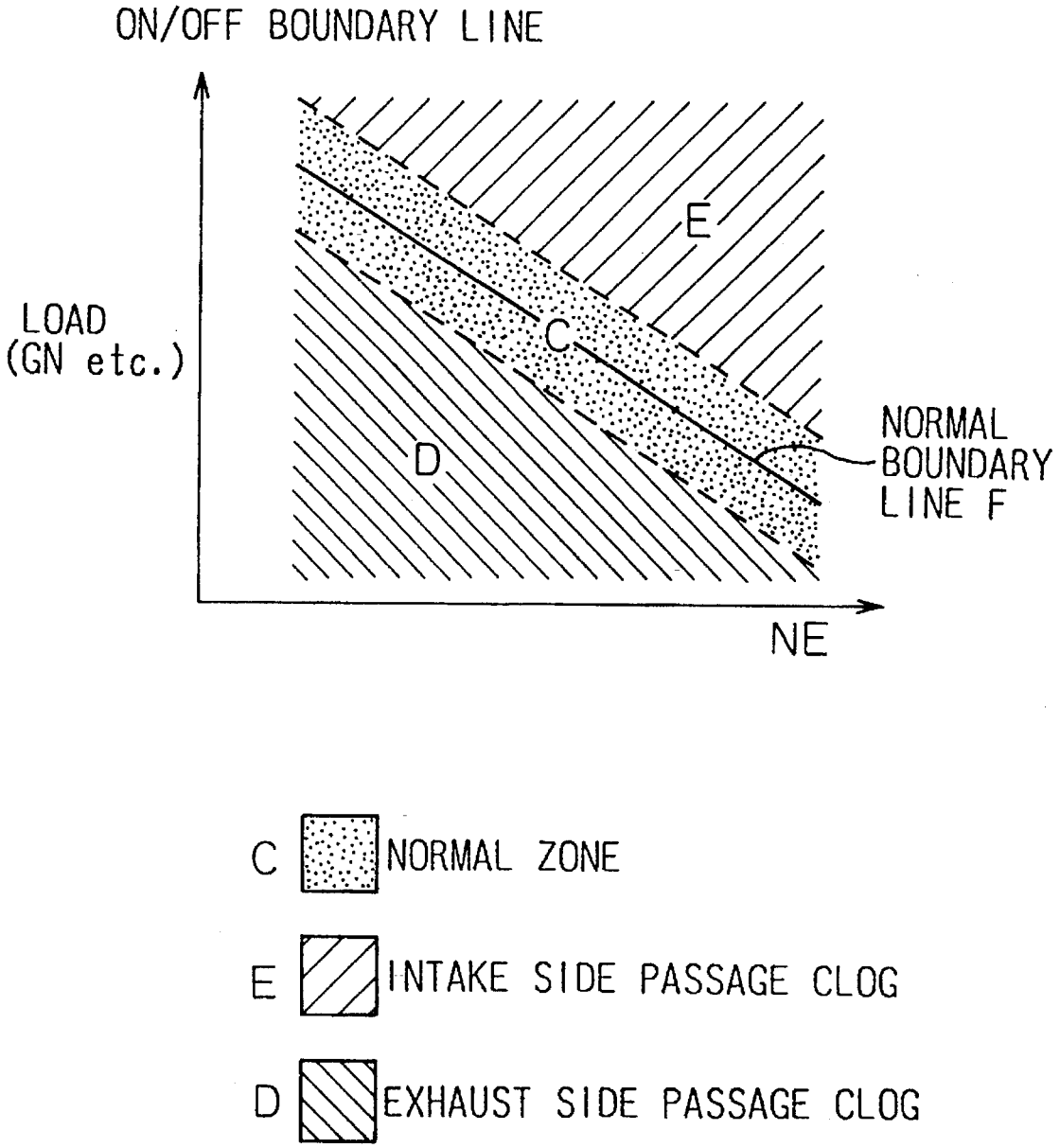
FIG. 10 is a chart illustrating a shifting zone of a boundary line between ON/OFF zone of the pressure switch calculated in the steps for diagnosing trouble in the exhaust-gas recirculation system shown in FIGS. 9A and 9B.

FIG. 10 illustrates the normal state boundary line F, a zone C of which is thought to be normal even though the boundary line in the ON/OFF characteristic curve of the pressure switch 70 is shifted therein, a zone E wherein the boundary line is shifted when the clogging occurs in the intake side EGR passage 8, and a zone D wherein the boundary line is shifted when the clogging occurs in the exhaust side EGR passage 8. As stated before, since the negative pressure in the negative pressure chamber 81 becomes small when the clogging occurs in the intake side EGR passage 8, it is difficult to make the pressure switch 70 turn OFF, which causes the ON/OFF boundary line F to shift to the zone E. Contrarily, since the negative pressure in the negative pressure chamber 81 becomes large if the clogging occurs in the exhaust side EGR passage 8, the pressure switch 70 is frequently OFF to cause the boundary line F to shift in the zone D. Therefore, it is possible to identify the position at which the clogging occurs in the EGR passage 8 by detecting the position of the ON/OFF boundary line of the pressure switch 70.

Accordingly, in this embodiment, when the determination conditions are satisfied (i.e., when the answer is "yes" at step 202) and the lift amount of the EGR control valve 9 is proper (i.e., when the answer is "no" both at steps 203 and 204), the rotational speed and the load of engine are plotted on the matrix map at steps 702 through 805 at an instant when the pressure switch 70 is OFF, so that the position of the ON/OFF boundary line F of the pressure switch 70 can be statistically calculated at step 901 from n points obtained above.

Then it is determined at step 902 whether or not the ON/OFF boundary line F of the pressure switch 70 thus calculated is in the zone C. If it is in the zone C, the control proceeds to step 207 at which it is determined that the EGR system is normal, and the routine is finished. On the other hand, if the ON/OFF boundary line F of the pressure switch 70 is not in the zone C, the control proceeds to step 903 at which it is determined whether or not the ON/OFF boundary line F of the pressure switch 70 thus calculated is in the zone D. If the ON/OFF boundary line F of the pressure switch 70 is in the zone D, the control proceeds to step 211 at which it is determined that the clogging occurs in the exhaust side EGR passage 8, and the routine is finished. While, if the ON/OFF boundary line F of the pressure switch 70 is not in the zone D, it is determined that the boundary line F is in the zone E, and the control proceeds to step 208 at which it is determined that the clogging occurs in the intake side EGR passage 82, and the routine is finished.

As stated above, in the embodiments shown in FIGS. 8 and 9, it is possible to improve the determination accuracy for the occurrence of clogging and prevent the erroneous determination because the clogging in the ERG passage 8 is determined based on the ON/OFF information of the pressure switch 70 in the respective zones determined at a predetermined times.

As described above, according to the apparatus for diagnosing trouble in the exhaust-gas recirculation system of the present invention, since it is possible to detect in the EGR system provided with the EGR control valve in the EGR passage whether the clogging of the EGR passage occurs upstream or downstream of the EGR control valve, the time required for repairing the trouble portion can be reduced.

What is claimed is:

1. An apparatus for diagnosing trouble in an EGR system comprising an EGR passage for communicating an exhaust passage to an intake passage of an internal combustion engine and an EGR control valve for controlling a flow rate of exhaust gas recirculating in the EGR passage, comprising;

an orifice provided in the EGR passage, pressure detection means for detecting a pressure in the EGR passage between the orifice and the EGR control valve, operation state detection means for detecting an operation state of the internal combustion engine, operation zone determination means for determining whether the operation state of the internal combustion engine is in a first zone wherein an amount of EGR is larger than a predetermined value or in a second zone wherein an amount of EGR is smaller than the predetermined value, valve-opening detection means for detecting an open state of the EGR control valve, and trouble determination means for determining whether or not clogging occurs in the EGR passage and whether the clogging occurs upstream or downstream of the EGR control valve, based on the operation zone and the pressure value detected by the pressure detection means when the EGR control valve is in the open state.

2. An apparatus for diagnosing the trouble as defined by claim 1, wherein the pressure detection means is a pressure sensor, and the valve-opening degree detection means is a lift sensor for detecting a lift amount of a valve body of the EGR control valve.

3. An apparatus for diagnosing the trouble as defined by claim 2, wherein the trouble determination means comprises:

a first determination means for determining that the EGR control valve is normal when the lift amount of the valve body of the EGR control valve is in a predetermined range having a central value defined as a target lift amount;

a second determination means for determining that the clogging occurs downstream of the EGR control valve if a value detected by the pressure sensor is smaller than a reference value when the EGR control valve is normal and the operation state of the internal combustion engine is in the first operation zone; and a third determination means for determining that the clogging occurs upstream of the EGR control valve if a value detected by the pressure sensor is larger than the reference value when the EGR control valve is normal and the operation state of the internal combustion engine is in the second operation zone.

4. An apparatus for diagnosing the trouble as defined by claim 1, wherein the pressure detection means is a pressure sensor capable of changing its ON/OFF states when the negative pressure exceeds a predetermined value, and the valve-opening detection means is a lift sensor for detecting a lift amount of the valve body of the EGR control valve.

5. An apparatus for diagnosing trouble as defined by claim 4, wherein said predetermined value of the pressure switch is selected so that, when the EGR control valve is normal, the pressure switch is in a first state (OFF) during the first operation state, while it is in a second state (ON) during the second operation state, whereby the ON/OFF state is changed between the first and second states.

6. An apparatus for diagnosing the trouble as defined by claim 5, wherein the trouble determination means comprises:

a first determination means for determining that the EGR control valve is normal when the lift amount of the valve body of the EGR control valve is in a range having a central value defined as a target lift amount;

second determination means for determining that the clogging occurs downstream of the EGR control valve if the pressure switch is in the second state when the EGR control valve is normal and the operation state of the internal combustion engine is in the first operation zone; and third determination means for determining that the clogging occurs upstream of the EGR control valve if the pressure switch is in the first state when the EGR control valve is normal and the operation state of the internal combustion engine is in the second operation zone.

7. An apparatus for diagnosing the trouble as defined by claim 5, wherein the trouble determination means comprises:

a first determination means for determining that the EGR control valve is normal when the lift amount of the valve body of the EGR control valve is in a range having a central value defined as a target lift amount;

first reversing frequency computing means for computing a frequency of the pressure switch being switched to the second state when the EGR control valve is normal and the operation state of the internal combustion engine is in the first operation zone;

second reversing frequency computing means for computing a frequency of the pressure switch being switched to the first state when the EGR control valve is normal and the operation state of the internal combustion engine is in the second operation zone;

second determination means for determining that clogging has occurred downstream of the EGR control valve if the frequency computed by the first frequency computing means is larger than a predetermined value when the EGR control valve is normal and the operation state of the internal combustion engine is in the first operation zone; and third determination means for determining that clogging has occurred upstream of the EGR control valve if the frequency computed by the second frequency computing means is larger than a predetermined value when the EGR control valve is normal and the operation state of the internal combustion engine is in the second operation zone.

8. An apparatus for diagnosing the trouble as defined by claim 5, wherein the trouble determination means comprises:

a first determination means for determining that the EGR control valve is normal when the lift amount of the valve body of the EGR control valve is in a range having a central value defined as a target lift amount;

a pressure-switch reversing boundary line memory means for memorizing, as a boundary line, points at which ON/OFF of the pressure switch is reversed on a map representing the relationship between the rotational speed and the load of the engine when the EGR control valve is normal and no clogging occurs in the EGR passage;

a determination map for memorizing a normal zone having a predetermined range provided parallel to the boundary line, an exhaust side clogging zone wherein a load is smaller than that in the normal zone for the same rotational speed of the engine, and an intake side clogging zone wherein a load is larger than that in the normal zone for the same rotational speed of the engine; and determination means for detecting positions of the load and the rotational speed of the engine in the determination map at the point where ON/OFF of the pressure switch is reversed, and determining that the clogging occurs in the exhaust side EGR passage if the reversing point is in the exhaust side clogging zone, while determining that the clogging occurs in the intake side EGR passage if the reversing point is in the intake side clogging zone.

* * * * *